United States Patent [19]

Hotchkiss et al.

[11] Patent Number: 4,697,720

[45] Date of Patent: Oct. 6, 1987

[54] TERMINAL BLOCK COVER

[75] Inventors: Kenneth W. Hotchkiss, Golden; Arthur B. Woodward, Lakewood, both of Colo.

[73] Assignee: Proto-Tel, Inc., Boulder, Colo.

[21] Appl. No.: 920,658

[22] Filed: Oct. 20, 1986

[51] Int. Cl.[4] ..... B65D 43/14; B65D 51/04

[52] U.S. Cl. ..... 220/337; 220/3.8; 220/306; 220/339; 174/72 A; 174/138 F

[58] Field of Search ..... 220/334, 337, 339, 338, 220/3.8, 356, 306, 357; 174/66, 72 A, 138 F; 339/36–39, 198 J

[56] References Cited

U.S. PATENT DOCUMENTS

| | | | |
|---|---|---|---|
| 2,774,472 | 12/1956 | Badalich | 220/306 X |
| 2,921,607 | 1/1960 | Caveney | 174/72 A X |
| 3,335,900 | 8/1967 | Mackiewicz | 220/306 |
| 3,485,937 | 12/1969 | Caveney | 174/72 A X |
| 3,836,826 | 9/1974 | Hotchkiss | 317/122 |
| 3,846,737 | 11/1974 | Spaulding | 220/307 X |
| 3,966,074 | 6/1976 | Hotchkiss | 220/3.8 |

*Primary Examiner*—George T. Hall
*Attorney, Agent, or Firm*—Kyle W. Rost

[57] ABSTRACT

A terminal block cover provides a cover body having a latch mechanism depending from a side edge of the cover and a hinge mechanism depending from the opposite side edge. The hinge mechanism includes a clip that engages the terminal block's fanning strip, a separable hinge connected between the clip and cover body for permitting removal of the cover body from the terminal block, and a locking device that prevents the cover body from being removed from the terminal block except when it is in a predetermined rotational position on the hinge. The clip provides a prong that engages the fanning strip to index the clip in a fixed position so that the cover body can be reinstalled at the original position. In addition, the clip is held to the hinge mechanism by spring fingers on the hinge pin housing, which cooperate with the locking device to hold the clips in attachment to the cover body even when not installed on a terminal block.

15 Claims, 8 Drawing Figures

TERMINAL BLOCK COVER

BACKGROUND OF THE INVENTION

1. Field of the Invention.

The invention generally relates to conductors and insulators. More specifically, the invention relates to boxes and housings, especially to covers or face plates for termainal housings. The invention also generally relates to receptacles, and more specifically to the outlet or junction box type, with closure. A termainal block cover is disclosed that is especially adapted for use with terminal blocks of the type employed with telephone systems.

2. Description of the Prior Art

The terminal block is a widely used commodity in commercial telephone installation equipment. The block usually is an elongated rectangle that is formed from nonconductive plastic material and supports a plurality of conductive wire terminators. The longitudinally elongated sides of the block carry fanning strips that aid in separating and supporting the many individual wires that are routed into the block. In a typical installation, one or more terminal blocks are mounted on a wall in vertical position, and telephone cables from a trunk system are routed to the blocks, where the individual wires of a trunk cable are individually attached to the separate terminating clips that are carried in the block. The terminating clip, also a well known device, is a metallic conductor that is capable of receiving and holding two or more separate wires in electrical contact with each other. Each separate terminating clip typically includes a distinct clip portion corresponding to each wire, all such clip portions being in electrical contact with each other, such that all wires that are to be connected via the same clip can be individually installed or removed. Thus, in incoming trunk cable containing, for example, twenty five wire pairs, will have its wires fanned out and attached to first clip portions of fifty individual terminating clips, which may be contained in a single terminal block. Then, these trunk system wires are readily available for individual connection to local telephone equipment by attachment of wires from the local system to the second clip portions of the terminating clips. The block, therefore, is an interface between trunk cables and local equipment, enabling the installer to easily and quickly identify the wire pairs of the trunk cable and make appropriate attachment to local system wires.

Terminal blocks are covered for protection of the terminating clips and wires and to prevent accidental short circuits or other damage to the internal connections. It is quite important that the covers be employed, as the terminal blocks often must be mounted in closets or storage rooms, where various types of mistreatment and contact with foreign matter is common. At the same time, the terminal block may be subject to frequent rewiring and must be available to telephone service technicians. Thus, the covers should be readily removable so that technicians can locate relevant wire pairs. Still another function of the cover is to provide a location for technicians to record informtion about the connections and equipment. Thus, the requirements of a good cover include firm, easy fastening to the block; rapid opening for inspection; and an ability to be written upon.

Various types of terminal block covers are known. For example, U.S. Pat. No. 3,836,826 discloses a snap-on cover that includes a means for preventing longitudinal sliding. U.S. Pat. No. 3,966,074 discloses a terminal block cover that has fastening elements that are adapted to engage parts of the fanning strips on the edges of the terminal block.

While these types of covers are excellent in their protective functions, it is often desirable to be able to open terminal block covers while retaining the cover on the block. This prevents mixing covers, which is especially important when information concerning the connections is written on the cover. Also, a semi-permanently attached cover is less subject to loss or theft and is more likely to be reinstalled after removal. Still another desirable feature is to have a cover that can be indexed to the terminal block by its position, so that information on the cover can be related to specific terminals within the block.

Another type of cover in present use, but for which no patent is known, employs a face plate of molded plastic with a plastic "living hinge" at one edge. The hinge is connected to a side plate that carries spring hooks that engage a plurality of the fanning strips on the sides of the terminal block. The opposite edge of the face plate carries another side plate, which includes a friction latch that engages over the fanning strips. This type of cover can be opened on its hinge and may stay attached to its terminal block even when open. Also, it may be removed from the terminal block by lateral pulling. Removal may be difficult, however, depending upon the amount of lateral space that is present. Also, the life of a plastic living hinge is short due to the quantity of fire-retardant that is required in plastic materials used in electrical service. A further disadvantage is that the side plate carrying the spring hooks largely covers the fanning strips on the hinge side of the terminal block, preventing the technician from wiring through that side of the block without entirely removing the cover.

Consequently, it would be desirable to have a hinged cover of improved hinge durability. Also, it would be desirable to have a cover that is capable of being removed even in close-mounting situations. In addition, after such a cover is removed, it would be desirable to have its position indexed to the terminal block, so that it will be reinstalled in an indentical location. Further, it would be desirable to have an attachment between the cover and terminal block such that substantially all of the fanning strips on the terminal block are accessible. In those instances when it is necessary to entirely remove the cover from the block, it would be desirable to have a cover that retains its indexing.

To achieve the foregoing and other objects and in accordance with the purpose of the present invention, as embodied and broadly described herein, the terminal block cover of this invention may comprise the following.

SUMMARY OF THE INVENTION

Against the described background, it is therefore a general object of the invention to provide an improved terminal block cover of the type that is semi-permanently installed.

More specifically, an object is to create a terminal block cover of plastic construction, wherein the structure is such that the necessary or required amounts of fire retardant materials can be used in the plastic without degrading the structure or operational life of the cover.

Another object is to create a termainal block cover that attaches to the fanning strip on one side of the block without substantially interfering with the ability of the fanning strip to be used for wiring purposes.

Still another object is to create a terminal block cover that can be removed from the terminal block while retaining the original indexing of the cover to the block.

An important object is to create a terminal block cover that can be separated from the terminal block only when in a preselected relative position to the block, with the result that the cover is positively retained on the terminal block in substantially all other positions, whether closed or open, and therefore is unlikely to be lost or inadvertently removed under normal handling.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a terminal block cover is provided for use with a terminal block of the type having a longitudinally extending face, bottom, and first and second opposite sides, with a fanning strip located along each of the first and second longitudinal sides and defining a laterally extending lip at the side margins of the terminal block face. A cover body, in use, covers the face of a terminal block, and a latch means depends from the cover body for releasably engaging the first lateral side of the terminal block. Further, a hinge means depends from the cover body, engages a fanning strip on the second lateral side of the terminal block, and permits the cover body to pivot thereon. The hinge means includes a clip means for engaging the fanning strip at a substantially fixed position; a separable pivot means connected between the clip means and cover body for permitting pivotal movement of the cover body with respect to the clip means and permitting removal of the cover body from connection with the clip means; and a positional locking means for preventing removal of the cover body from connection with the clip means only when the cover body and clip means are in first predetermined relative pivotal positions on said pivot means, and permitting removal of the cover body from connection with the clip means when the cover body and clip means are in second predetermined relative pivotal positions on the clip means.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENTS

Figure 1:
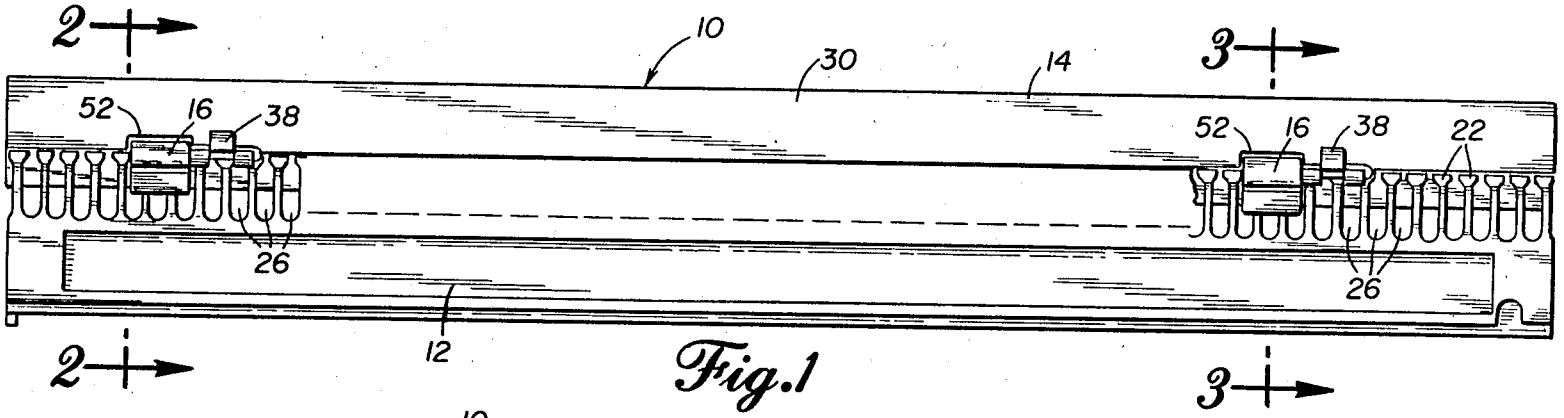
FIG. 1 is a side elevational view of the terminal block cover as installed on a terminal block, as viewed from the hinge side of the cover.

With reference to the drawings, the terminal block cover assembly 10 is a three sided lid that fits over the top of a conventional terminal block 12. The cover is formed from two components, the first being the cover body 14 and the second being the pin unit 16. Each cover body 14 is connected to two or more pin units 16 to form an entire cover assembly 10. When the lid has been installed and is closed over a terminal block, the lid covers the face of the block and latches on one side. The second side is mounted on hinges that protrude laterally from the side of the block and pivot on an axis that is parallel to the longitudinal dimension of the terminal block. The hinges may be separated when the lid is partially open, such as at ninety degrees, to allow removal of the lid. At other open positions, the hinges are locked against separation.

Figure 2:
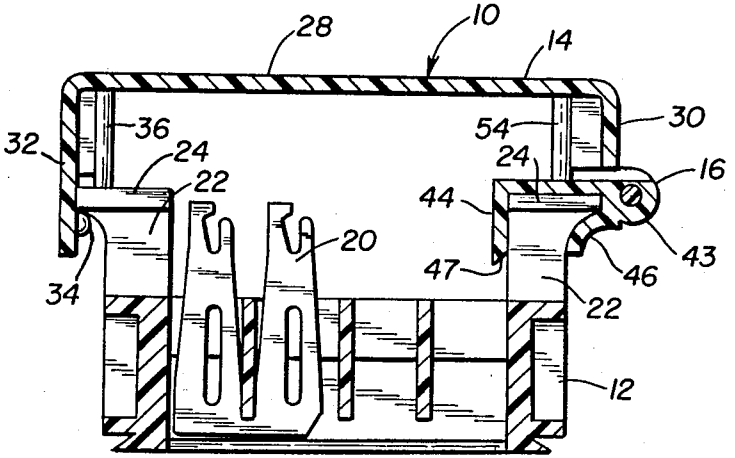
FIG. 2 is a cross-sectional view taken along the plane of line 2—2 of FIG. 1, showing a detail of hinge construction.

The terminal block 12 is an existing and well known element of telephone installation equipment. As can be seen in the drawings, the terminal block is in the general shape of an elongated rectangle, which is formed from a suitable electrically nonconductive material such as a plastic. The longitudinal surfaces of the terminal block include a face, an opposed bottom, and first and second opposite sides, with a row of fanning strips located along each of the first and second longitudinal sides and defining the side margins of the terminal block face. FIG. 2 shows that the block also is a rectangle in transverse cross-section.

Figure 4:
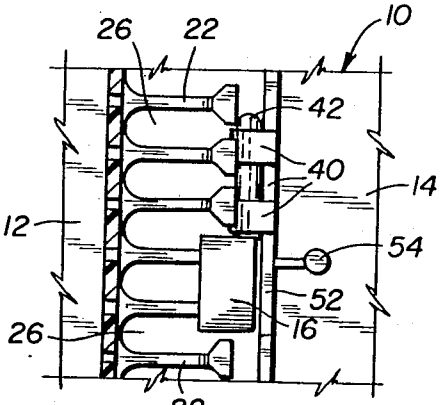
FIG. 4 is a fragmentary side elevational view of a hinge area of the cover taken from inside the terminal block, with the cover installed on a terminal block, with the face plate of the cover open to ninety degrees to the terminal block, showing the relationship of the main cover to a pin unit.

Defined within the terminal block body in longitudinally spaced sequence are a plurality of cavities 18, FIG. 2, that receive and retain conductive metal terminating clips 20. As best shown in FIGS. 1 and 4, the upper portion of the longitudinally extending side walls of the block are defined by rows of fanning strips 22, which are upstanding between the bottom and face of the terminal block. Each fanning strip is T-shaped in side view and ends at the face of the terminal block with a widened cap 24. A wire passage 26 is thus formed between adjacent fanning strips and has a narrow entrance formed between the widened caps 24. Each fanning strip is laterally aligned with a transversely extending terminating clip, with the resultant structure permitting a wire to be passed to a separate terminating clip through substantially each passage 26. Further, FIG. 2 shows that the cap 24 of each T-shaped fanning strip 22 is lengthened not only longitudinally but also laterally, such that the caps 24 form a laterally outwardly extending flange along the top edge of the longitudinally extending side of the terminal block.

The cover 10 fits over the top face of the terminal block and mates with the side walls of the block to provide a three-sided shield over the terminating clips and their connections to the telephone cable wires. The three sides of the cover body 14 include a face plate means or top wall 28 for covering the face of the terminal block. The second side of the cover body constitutes a hinge means, which may include a hinge side wall 30 depending from the face plate and pivotally engaging a pin unit 16. The pin unit, in turn, includes a clip means for engagement with a fanning strip on one of the lateral sides of the terminal block. A pivot means is connected between the clip means and cover body for permitting pivotal movement of the cover body with respect to the clip means. Also, the pivot means permits removal of the cover body from connection with the clip means and thereby allows the cover body to be removed from the terminal block. The third side is a latch means or latch side wall 32 depending from the face plate for releasably engaging the other lateral side of the terminal block. The two side walls 30 and 32 are longitudinally perpendicular to the face plate and depend from its lower surface in order to follow the shape of the terminal block.

The latch side wall 32 includes two cooperating elements that constitute a latch means. First, a rib 34 is connected to the latch side wall and extends inwardly, toward the hinge side wall 30. Second, one or more stand-offs 36 are connected to the top wall 28 and latch side wall 32 and extend downwardly toward the rib 34, terminating at a predetermined height above the rib, for example $\frac{1}{8}$ inch above the upper edge of the rib. The gap that is thus created between the top of the rib 34 and the bottom of the stand-off 36 provides a reception area for latching engagement of the laterally extending flange of the terminal block, formed by the T-shaped caps 24. The flexibility and resiliency of the plastic walls of the cover 10 permit latch side wall 32 to deflect over the cap flanges 24 during engagement and disengagement of the latch. The rib 34 may be shorter than the length of the cover and is preferred to be centrally located with respect to the length of the cover. For example, the rib may be one inch long on a cover having a ten inch length. The stand-offs 36 may be longitudinally offset from the position of the rib. For example, two such stand-offs may be employed, one on each longitudinal end of the rib, each being offset longitudinally about half way between the closest end of the rib and the nearest longitudinal end of the cover.

The hinge side wall 30 and pin units 16 define a separable pivot means for allowing both the pivotal hinging motion of the cover body 14 with respect to the terminal block and removal of the cover body from the termainal block. The hinge side wall 30 of the cover may have a hinge pin housing 38 connected to its outside surface. A preferred housing is formed from three or more spring fingers 40 that are composed of the same flexible, resilient plastic material as the cover body. Each finger forms approximately a semi-circular ring around a central cylindrical, longitudinal cavity that is sized to receive a hinge pin 42 of the pin unit. The fingers are axially juxtaposed and offset on alternating radially opposite sides of the cavity axis. One end of each finger is attached to the cover body at the hinge wall, and the other end is free, which permits each finger to flex from its attached end. When three such fingers are employed, the finger in the center position is alone on one radial side of the hinge axis and is opposed by the remaining two fingers, each of which is at an opposite axial end of the axis and is opposed to the central finger by one-half revolution. Thus, each finger is unrestricted by the others in its ability to flex radially to the housing axis so that the fingers are free to clamp the pin 42. At the same time, the fingers define a substantially continuous cylinder wall around the cavity, which permits longitudinal reception and removal of the pin.

The hinge pin 42 is a part of the pin unit 16 and is attached at one end to a generally cylindrical base portion 43 of the pin unit that is of larger diameter than the pin and thereby provides a supporting surface at the attached end for contact with the hinge pin housing. The diameter of the pin is slightly larger than the diameter of the cavity in the hinge pin housing, so that the pin will be held in the housing under pressure of the flexible fingers. The diameter of the pin base may be similar to the diameter of the cylinder defined by the hinge pin housing. In use, the cover assembly 10 is expected to be mounted in vertical position, so that the pins 42 extend upwardly from the pin bases 43. Thus, the cover body 14 is retained on the pins by gravity and is not required to rely on the gripping strength of the fingers to hold the cover in place. The pin base 43 therefore provides the expected resting surface that limits the engagement of the pin into the hinge pin housing.

The pin unit includes a clip means for engaging the fanning strip at a substantially fixed position, with the result that the pin is held in a stationary longitudinal position on the terminal block. FIG. 2 shows part of the attachment between the clip means and terminal block to be by a pair of flexible clip fingers connected to the pin base 43, including an inside finger 44 and an outside finger 46, each of which fits a surface contour of a fanning strip. Inside finger 44 has an inside bevel on its leading end 47 that serves as a camming means for guiding the deflection of the leading end during installation of the pin base on the terminal block, which will be described below.

Further, the inside finger is generally L-shaped, with the longer arm including a shank 48 that is connected to the pin base and fits over the top of the fanning strip cap 24. The shorter arm constitutes a flange or lip that depends perpendicularly from the shank and engages the inside surface of a fanning strip. The shank may establish a face plane 49, FIGS. 7 and 8, that extends through the pin base and results in the diameter of the pin base being reduced where truncated by the face plane. Thus, the supporting surface for the hinge pin housing may be small or absent on the side of the pin base that is cut by the face plane 49. This feature is employed in conjunction with the locking means described below.

Figure 3:
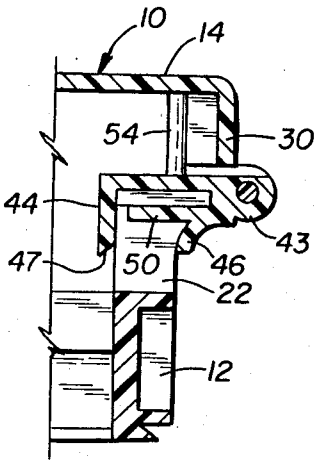
FIG. 3 is a fragmentary cross-sectional view taken along the plane of line 3—3 of FIG. 1, showing another detail of hinge construction.

Another part of the clip means is central prong or tongue 50, as shown in FIG. 3. This tongue is connected to the pin base 43 near the junction of the outside finger and extends parallel to and spaced below the shank of the inside finger. A gap is formed between the tongue and shank, which is of appropriate height to permit reception of a fanning strip cap 24.

The tongue fits through the side of a wire passage 26 and is retained under a pair of neighboring caps 24 to index the clip means in a fixed position along the longitudinal dimension of the terminal block. The tongue is limited in its maximum width to the maximum width of a wire passage, and thus may be approximately ⅛ inch wide. In contrast, the fingers and shank may be considerably wider and overlie two or more fanning strip caps 24, such that the shank and fingers cover one fanning strip cap on each side the wire passage engaged by the tongue.

The cover body 14 also defines a positional locking means for preventing removal of the main cover from connection with the clip means, but only when the face plate and clip means are in preselected relative pivotal positions with respect to the pin base. The locking means may comprise a notch 52, FIGS. 1 and 5, in the free edge of the hinge side wall, longitudinally juxtaposed to each hinge pin housing. The notch is longitudinally sized to receive the length of the pin base. Also, the notch has a predetermined height in the hinge side wall, as viewed in FIG. 1, that is sufficient to receive and have clearance with the maximum diameter of the pin base as the cover is rotated on the hinge pin axis to orbit the pin base.

Figure 5:
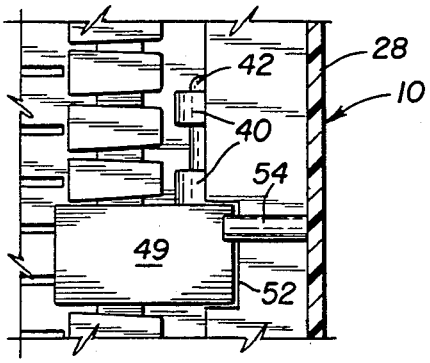
FIG. 5 is a cross-sectional view taken along the plane of line 5—5 of FIG. 4, showing the relationship of main cover to a pin unit.

The locking means operates by engaging the pin base in the notch, which prevents the pin and hinge housing from sliding longitudinally with respect to each other. FIG. 1, for example, shows how the notch and pin base are engaged when the cover is closed on the terminal block. The notch engages the pin base on the inside edge of the hinge pin in the closed position of FIG. 1. However, when the cover is opened by ninety degrees, as shown in FIGS. 4 and 5, the hinge pin housing has elevated the hinge side wall 30 above the face plane 49 of pin base 43, and the notch has been rotated into position parallel with the face plane 49. Thus, according to FIG. 4, the notch 52 is in position to clear the face plane and, consequently, the pin and hinge pin housing can be moved longitudinally with respect to each other. Upon further opening of the cover to 180 degrees, as shown in FIG. 6, the notch again engages the pin base, now on the outside edge of the hinge pin, and locks the hinge against separation.

The locking means operates by having a cylindrical hinge pin housing that is attached to and supports the hinge side wall 30 in a tangential position to the core of the housing. Thus, the plane of the hinge side wall 30 is a chord to the hinge pin housing wall, with the plane intersecting the cylindrical side of the hinge pin housing 38. The pin 42 is engaged coaxially in the housing core, and the pin base is sized to a similar large diameter as the hinge pin housing. Accordingly, the hinge side wall 30 also is a chord to the pin base 43 and receives the pin base in a notch formed within the hinge side wall, which prevents actual physical interference between the plane of the chord defined by the hinge side wall 30 and the cylindrical surface of the pin base 43. The shape of the pin base 43 is modified by a flattening at face plane 49, which provides substantially a single position of relative rotation in which the plane the hinge side wall can traverse the wall of the cylindrical pin base without physical interference. Hence, at the single predetermined position of non-interference, the hinge side wall and its attached hinge pin housing can be moved longitudinally with respect to the pin base.

Figure 6:
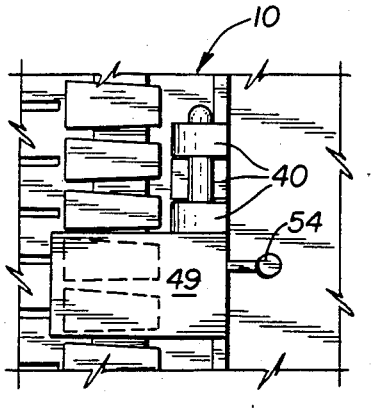
FIG. 6 is view similar to FIG. 5, but with the cover open to 180 degrees from the terminal block.

At the same longitudinal position as each notch on the cover body 14, a pin unit stand-off 54, FIGS. 5 and 6, depends from the top wall 28 and also may be joined to the hinge side wall 30. This stand-off 54 terminates at a free end that overlies the position of the pin unit when the cover is closed on the terminal block. The stand-off 54 contacts the pin unit on the face plane 49 of the shank when the cover unit and pin unit are in closed position, as shown in FIGS. 2 and 3. Thus, one function of the stand-off 54 is to space and support the hinge side of the cover body away from the face of the terminal block, in cooperation with the stand-offs 36 on the latch side. A second function is to support the pin units with respect to the cover body in a position equivalent to the closed position of the cover body on the terminal block. The latter function is useful for assuring that the pin units remain in locked position with respect to the cover body, such as during shipping. The latter function also aids in installation of the cover assembly to a terminal block.

Figure 7:
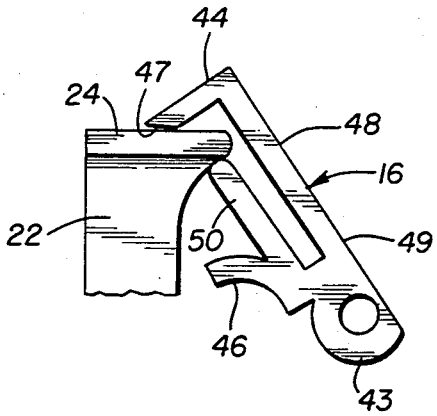
FIG. 7 is a fragmentary side view of a pin unit being installed on the fanning strip of a terminal block, showing an initial position of the pin unit.
Figure 8:
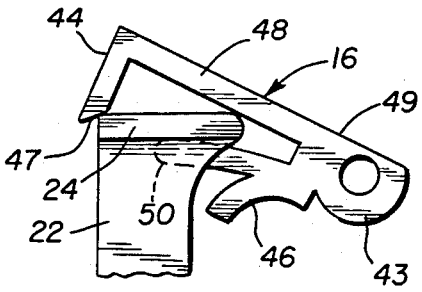
FIG. 8 is a view similar to FIG. 7, showing an intermediate position of the pin unit.

FIGS. 7 and 8 show stages in the installation of the pin unit to a terminal block. It is possible to install the pin units by hand, when they are removed from the cover body. However, the preferred installation method starts with the the pin units attached to the cover body and in closed position. Thus, each pin unit is to be attached to the cover body by engagement of the hinge pin in the hinge pin housing, where the spring fingers grip the hinge pin and prevent loss of the pin unit. Each pin unit is to be supported by a stand-off 54 during combined installation of the entire cover assembly. In such condition, the pin units first are moved into the position of FIG. 7, wherein the tongue 50 approaches the underside of caps 24 and begins to enter a wire passage 26 between two fanning strips 22. At the same time, the bevel 47 on the tip of the inside finger 44 is applied to the top of caps 24, where the bevel assists in deflecting the inside finger and shank while the inside finger slides over the top of caps 24.

As the installation progresses to the position of FIG. 8, the pin base 43 is raised with respect to the fanning stip, and the inside finger 44 and tongue 50 are deflected mutually apart and are placed in tension by their resiliency. The beveled leading edge of the inside finger slides forwardly, to the left in FIGS. 7 and 8, until it snaps over the caps 24. In final, installed position, the pin base appears as shown in FIGS. 2 and 3, wherein the fingers 44 and 46 and tongue 50 are engaging the caps of the fanning strips. The tongue 50 then aids in retaining the pin unit on the terminal block by being placed in tension when lifting forces are applied to the free end of the inside finger. Because of the support provided by the stand-offs 54, the entire installation may be accomplished by moving the cover body 14, with the stand-offs applying the necessary force to the pin units.

Installation of the cover assembly as a whole in this manner has the advantage of automatically correctly positioning the multiple pin units to carry the cover body in the desired longitudinal position with respect to the terminal block. Once correctly installed, the pin units need not be removed and will maintain their correct longitudinal spacing and positioning without further support from the cover body. Therefore, the pin units will be correctly indexed and positioned for re-hanging of the cover body after it has been removed. Also, such removal and re-installation of the cover, coupled with the small longitudinal length of the pin units compared to the terminal block, allows the installer to wire the terminal block from the hinge side, if desired.

In use, the block 12 is mounted on a wall with its longitudinal dimension positioned vertically. Telephone wire cable from outside the terminal block is separated into its individual wires, which are passed into the block through wire passages 26 between the fanning strips 20.

Each wire is connected to a terminating clip. The cover assembly 10 is preassembled with pin units 16 held in the hinge pin housings 38 by the spring tension of the fingers 40 and the engagement of the pin bases in notches 52.

The cover assembly 10 is installed on the block 12 by positioning the pin units to engage a fanning strip with the pins 42 extending upwardly from the pin bases. The tongues 50 are inserted into wire passages from the outside surface of a fanning strip at appropriate locations to index the cover in the desired longitudinal position with respect to the terminal block, and the free ends of the inside clip fingers 44 are placed on the top of the fanning strip caps 24 with the beveled end 47 against the caps. The cover body is thus held in a plane angled at about forty-five degrees to the plane of the terminal block face. Then the cover assembly is slid in the direction of the opposite row of fanning strips and rotated slightly to reduce the angle with the terminal block face. Such sliding and rotation tensions the inside clip finger and tongue in mutually opposite directions, as these are increasingly deflected. With further sliding, the inside finger 44 snaps over the engaged fanning strips, and the outside finger 46 rests against the bottom outside surface of the flange formed by the caps 24. The assembly then is complete.

The cover body then is capable of being pivoted on the hinge pins 42, both to close and open the cover. Removal requires that the cover be opened to the predetermined position at which the hinge side wall is pivoted out of longitudinal interference with the pin bases, after which the cover body is lifted longitudinally to slide the hinge pin housings off the free ends of the pins 42. Reassembly requires reengaging the pin housings on the pins, with the cover body in an equivalent, noninterfering position with respect to the pin bases. When the pins are received in the housings, the cover body may be rotated to close or further open the cover, as desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. A terminal block cover for use with a terminal block of the type having a longitudinally extending face, bottom, and first and second opposite sides, with a fanning strip located along each of the first and second longitudinal sides and defining a laterally extending lip at the side margins of the terminal block face, comprising:

a cover body for, in use, covering the face of a terminal block;

a latch means depending from said cover body for, in use, releasably engaging the first lateral side of the terminal block; and a hinge means depending from the cover body for, in use, engaging a fanning strip on the second lateral side of the terminal block and permitting the cover body to pivot thereon, wherein said hinge means comprises:

a clip means for engaging the fanning strip at a substantially fixed position;

a separable pivot means connected between the clip means and cover body for permitting pivotal movement of the cover body with respect to the clip means and permitting removal of the cover body from connection with the clip means; and a positional locking means for preventing removal of the cover body from connection with the clip means only when the cover body and clip means are in first predetermined relative pivotal positions on said pivot means, and permitting removal of the cover body from connection with the clip means when the cover body and clip means are in second predetermined relative pivotal positions on the clip means.

2. The terminal block cover of claim 1, wherein said clip means comprises:

a base;

a flexible clip finger connected to said base and extending therefrom to define a shank portion thereof that, in use, overlies the top surface of a fanning strip, and having a substantially perpendicular flange portion depending from said shank portion that, in use, clips over the inside face of a fanning strip; and a tongue connected to the base and extending therefrom at a position spaced below and substantially parallel to said clip finger for, in use, engaging a wire passage of a fanning strip and indexing the longitudinal position of the clip on the terminal block.

3. The terminal block cover of claim 2, wherein said flange of said clip finger has a leading edge having an inside bevel on its end surface for, in use, camming the deflection of the finger over the fanning strip during application to the terminal block.

4. The terminal block cover of claim 2, wherein said pivot means comprises a hinge pin carried by said base, wherein the base includes a pin-supporting portion thereof in substantial axial alignment with the hinge pin and extending radially beyond the radius of the hinge pin through a first segment of the base through a first portion of the circumference of the hinge pin, wherein a second segment of the base through a second portion of the circumference of the hinge pin is of smaller radius than said first segment.

5. The terminal block cover of claim 4, wherein said shank portion is joined to said base at said pin-supporting portion and the face of the shank portion defines a face plane, substantially parallel to the hinge pin axis, forming the surface of the base through said second segment.

6. The terminal block cover of claim 5, wherein said positional locking means comprises:

a hinge side wall depending from an edge of said cover body opposite from said latch means and having a free lower edge defining therein a notch, the hinge side wall carrying at a longitudinally offset position from the notch a hinge pin housing having a longitudinally extending cavity for receiving said hinge pin;

wherein the notch is longitudinally parallel to said pin-supporting portion of the base and is radially offset from the cavity axis whereby the notch orbits the hinge pin at a predetermined radius when the hinge pin is axially received in the cavity and is rotated with respect thereto; and wherein said predetermined orbit radius of the notch is greater than the radius of the base at said face plane defined by the shank and less than the radius of the base through said first portion of the circumference of the hinge pin, whereby the notch is longitudinally locked over the base when orbiting through the first portion of the hinge pin circumference and is longitudinally unlocked from the base when orbiting over said face plane.

7. The terminal block cover of claim 6, wherein said hinge pin housing comprises:

a first flexible, resilient hinge finger defining said hinge pin cavity, one end of said hinge finger being connected to said hinge side wall and the opposite end being free.

8. The terminal block cover of claim 6, further comprising a stand-off connected to said cover body at the longitudinal position of said notch, the stand-off overlying and contacting said shank on said face plane and limiting the inward pivotal motion of the clip means toward the inside face of the cover body.

9. The terminal block cover of claim 7, further comprising a second hinge finger having one end attached to said hinge side wall and having the opposite end free, said second hinge finger being longitudinally juxtaposed to said first hinge finger and defining a portion of the hinge pin cavity, wherein the first and second hinge fingers each form a partial ring and extend around the hinge cavity in opposite circumferential directions.

10. An improved terminal block cover of the type having a longitudinally extending face plate and having a latching side wall depending from a first lateral side of the face plate, wherein the improvement comprises:

a hinge side wall depending from a second lateral side of the face plate;

a clip means for, in use, engaging a terminal block; and a pivot means selectively interconnectable between said hinge side wall and said clip means for permitting relative pivotal motion therebetween; wherein said pivot means comprises:

a longitudinally extending hinge pin attached to a first of said clip means and hinge side wall;

a hinge pin housing attached to the second of the clip means and hinge side wall and defining a longitudinally extending cavity for reception of said hinge pin; and a locking means for preventing relative longitudinal motion between said hinge pin housing and hinge pin when the hinge side wall and clip means are in a first relative rotational position and for permitting relative longitudinal motion therebetween when the hinge side wall and clip means are in a second relative rotational position.

11. The terminal block cover of claim 10, wherein said clip means comprises:

a base;

a first clip finger connected to said base and having a laterally extending shank and a depending lip for, in use, clipping over a portion of a terminal block;

a second clip finger connected to said base below the first finger and extending laterally therefrom in approximately the same direction as the first finger for, in use, clipping under a portion of a terminal block in cooperation with the first finger; and a tongue connected to said base at a location between the first and second fingers and extending laterally therefrom in approximately the same direction as the first finger for, in use, entering a portion of a terminal block and indexing the clip means against longitudinal displacement.

12. The terminal block cover of claim 10, wherein said hinge pin housing comprises:

a plurality of resilient, flexible hinge fingers, each of said fingers being connected at one end to said clip means or hinge side wall and being free at the opposite end; said fingers extending laterally of the hinge side wall and being juxtaposed in longitudinal sequence.

13. The terminal block cover of claim 12, wherein said fingers each define approximately a one-half ring and adjacent fingers define opposite half rings around a central cavity for reception of said hinge pin.

14. The terminal block cover of claim 10, wherein said locking means comprises:

a locking body of at least partially larger diameter than said hinge pin connected to and axially aligned with the hinge pin, wherein with respect to each other a first portion of the locking body is of relatively greater diameter and a second portion of the locking body is of relatively smaller diameter; and wherein said hinge side wall defines a notch therein at a longitudinal position corresponding to the relative longitudinal position of the locking body with respect to the hinge side wall when the hinge pin is received in the hinge pin housing;

the diameter of said first and second portions of the locking body are such that the first portion is longitudinally engaged in the notch and the second portion is longitudinally free of the notch when each portion is respectively rotated closest to the notch on the axis of the hinge pin; and the hinge pin housing and hinge pin, when engaged, are offset laterally from the hinge side wall such that relative rotation therebetween selectively engages and disengages the notch with said respective first and second portions of the locking body.

15. The terminal block cover of claim 10, wherein said locking means comprises:

a notch defined in said hinge side wall; and a pin base connected to said clip means and carrying said hinge pin, the pin base having a relatively larger and a relatively smaller radial dimension at respective first and second circumferential positions around the axis of the pin, the pin base and notch having substantially juxtaposed, parallel longitudinal positions when the hinge pin is engaged in the hinge pin housing, wherein said first radial dimension is large enough that the pin base is engaged laterally in the notch when the notch is rotated about the pin axis to said first circumferential position, and the second radial dimension is small enough that the pin base is laterally free of the notch when the notch is rotated about the pin axis to said second circumferential position.

* * * * *